US005539963A

United States Patent [19]

Fujiwara et al.

[11] Patent Number: 5,539,963

[45] Date of Patent: Jul. 30, 1996

[54] CLIP HAVING A CLIP BODY AND A PRESSING COVER

[75] Inventors: Hirozumi Fujiwara; Toshimichi Tani, both of Tokyo, Japan

[73] Assignee: Tokyo Kinzoku Industry Co., Ltd., Tokyo, Japan

[21] Appl. No.: 357,204

[22] Filed: Dec. 13, 1994

[51] Int. Cl.[6] ..... B42F 1/02

[52] U.S. Cl. ..... 24/536; 24/67.5

[58] Field of Search ..... 24/536, 537, 67 R, 24/67.5

[56] References Cited

U.S. PATENT DOCUMENTS

| | | | |
|---|---|---|---|
| 890,241 | 6/1908 | Livingston | 24/536 X |
| 3,950,829 | 4/1976 | Cohen | 24/536 X |
| 4,920,614 | 5/1990 | Tsukamoto | 24/537 X |
| 5,349,724 | 9/1994 | Bracco et al. | 24/537 X |

FOREIGN PATENT DOCUMENTS

| | | | |
|---|---|---|---|
| 55548 | 9/1912 | Austria | 24/536 |
| 3-4082 | 1/1991 | Japan . | |
| 15925 | 5/1894 | United Kingdom | 24/536 |

*Primary Examiner*—James R. Brittain

*Attorney, Agent, or Firm*—Beveridge, DeGrandi, Weilacher & Young, L.L.P.

[57] ABSTRACT

A clip body having upper and lower clamping pieces which flare continuously and from both ends of a bending portion in a desired width and a pressing cover having upper and lower clamping pieces continuously extending from both ends of a bending portion which is formed so as to provide a desired width, in which tops of the upper and lower clamping pieces are to be engaged with upper and lower parts close to the bending portion of said clip body, and a width formed between the tops being narrower than the maximum width formed between the upper and lower clamping portions of the clip body and wherein the pressing cover being slidably provided on the outer portions of the clip body so that both the upper and lower clamping pieces of the clip body approach each other in a pressing state.

3 Claims, 5 Drawing Sheets

FIG. 1(a)
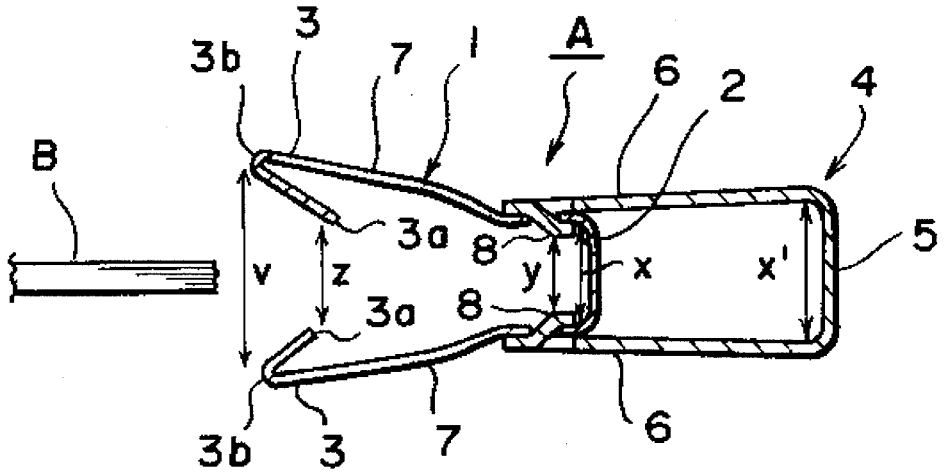
FIG. 1(b)
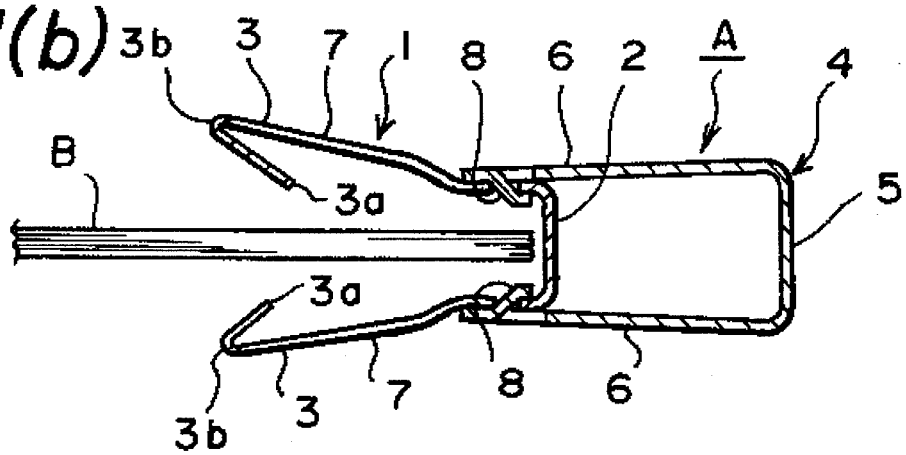
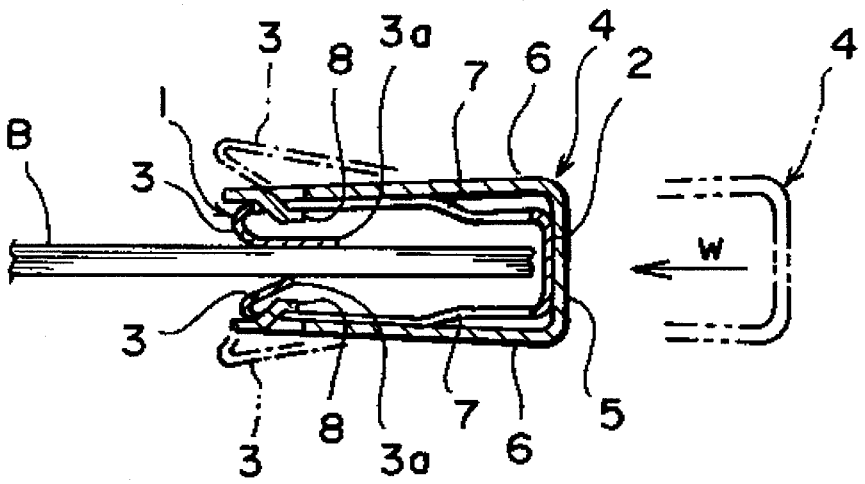
FIG. 1(c)

CLIP HAVING A CLIP BODY AND A PRESSING COVER

BACKGROUND OF THE INVENTION

DETAILED DESCRIPTION OF THE INVENTION

1. Field of the Invention

The present invention relates to a clip used for clamping documents or the like to bind them into a sheaf.

2. Statement of the Prior Art

As conventional clips, there have been known a double clip the operating lever of which is operated by fingers so that a gap between abutting portions thereof is expanded in use, a ring-shaped zem clip which has been wound doubly, a clip having upper and lower abutting pieces formed by bending an elastic plate-like body and used by employing a predetermined extruding unit (clip mounting unit), and the like.

However, in the case of the above double clip, although there are no problems as to clamping force, there are drawbacks. When the double clip is large-sized, large force is required for the operation of widening the distance between the abutting faces, and sometimes the distance between the abutting faces cannot be widened. Also, because the operating lever is obstructive, documents are bulky when bound into a sheaf by the double clip and placed one upon another. The zero clip has such a drawback that, because documents are only clamped between rings, clamping force is weakened whereby bulky documents can be hardly bound in a sheaf.

Further, in the clip which must use the above extruding unit, force is not required with simple operation and it has sufficient clamping force. However, the clip extruding unit is separately required.

In view of the above, the applicant has contrived a clip which obtains clamping force by blockading upper and lower abutting faces which are expanded by pressing force without using a separate mounting unit, in comparison with the zem clip and other conventional clips in which the upper and lower abutting faces which are in a blockade state are expanded by some external force once, and then documents or the like are clamped by its return force from the upper and lower sides, and the like.

The present invention has been made in view of those problems with conventional clips, and an object of the present invention is to provide a clip which requires no clip mounting unit, and which is simple in operation and excellent in clamping force.

SUMMARY OF THE INVENTION

In order to achieve the above object, technical means of the present invention comprises a clip body having upper and lower clamping pieces which flare continuously from both ends of a bending portion in a desired width; and a pressing cover having upper and lower clamping pieces continuously extending from both ends of a bending portion which is formed so as to provide a desired width, in which tops of said upper and lower clamping pieces are to be engaged with upper and lower parts close to the bending portion of said clip body, and a width formed between said tops is narrower than a maximum width formed between the upper and lower clamping portions of the clip body; wherein said pressing cover is slidably provided on the outer portions of the clip body so that both of the upper and lower clamping pieces of the clip body approach each other in a pressing state.

Also, the tops of the upper and lower clamping pieces of the clip body may be bent inwardly.

Further, the clip body and the pressing cover may be made of an elastic material.

Still further, guide grooves may be defined on the upper and lower portions of the clip body, and guide pieces which coincide with the guide grooves may be provided on the tops of the upper and lower clamping pieces of the pressing cover.

With the above technical means, because the clip body is formed in such a flared manner that the distance between the upper and lower clamping pieces are expanded from the bending portion, bound material such as documents can be smoothly inserted into the interior of the clip.

Thereafter, when the pressing cover is slidably pressed on the outer portions of the clip body, then the upper and lower clamping pieces of the cover press inwardly the upper and lower clamping pieces of the clip body from the exterior so as to slide before and behind in such a manner that both the upper and lower clamping pieces of the clip body approach each other because the inserting width formed between the upper and lower clamping pieces of the cover is narrower than at least a maximum width formed between the upper and lower clamping pieces of the clip body.

BRIEF DESCRIPTION OF THE DRAWING

FIGS. 1(*a*)–1(*c*) are longitudinal sectional side views showing the operation of a clip body and a slide cover constituting a clip of the present invention.

DETAILED DESCRIPTION OF THE PREFERRED EMBODIMENTS

Hereinafter, an embodiment of the present invention will be described with reference to the accompanying drawings.

In the figures, reference letter A denotes a clip in accordance with the present invention, and the clip A is comprised of a clip body 1 and a pressing cover 4, and formed by bending a desired flat-plate-shaped body such as metal plates, synthetic resin plates or the like. The material may be of elastic materials or non-elastic materials.

Figure 2A:
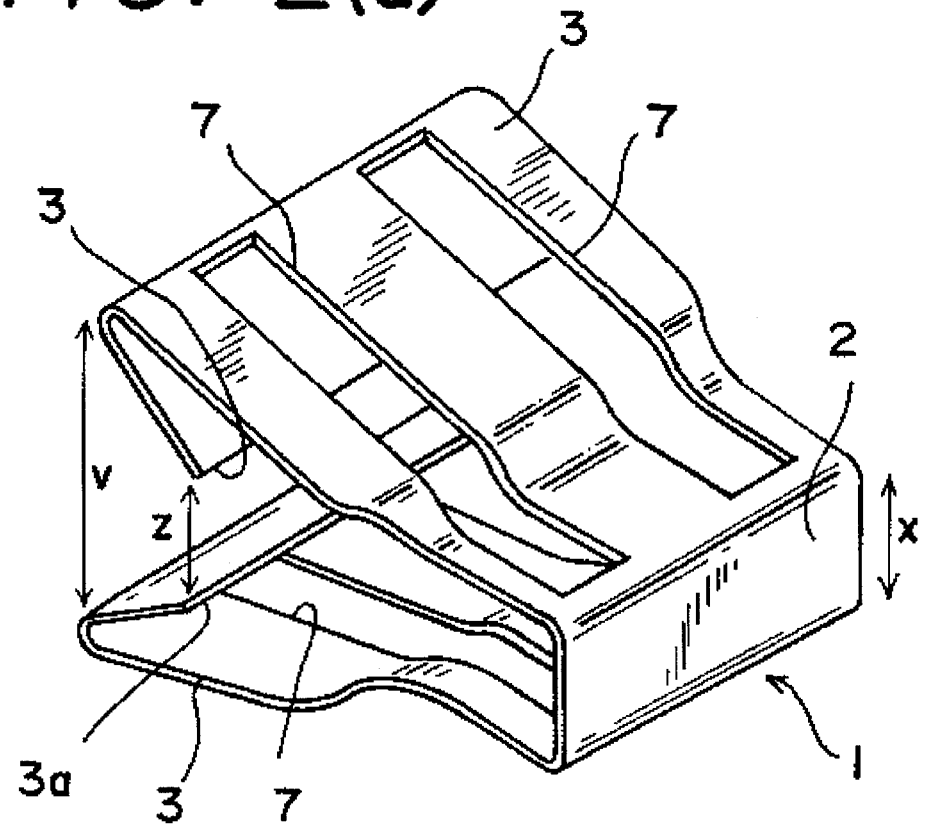
FIGS. 2(*a*) and 2(*b*) are exploded perspective views showing the clip in accordance with the present invention.
Figure 2B:
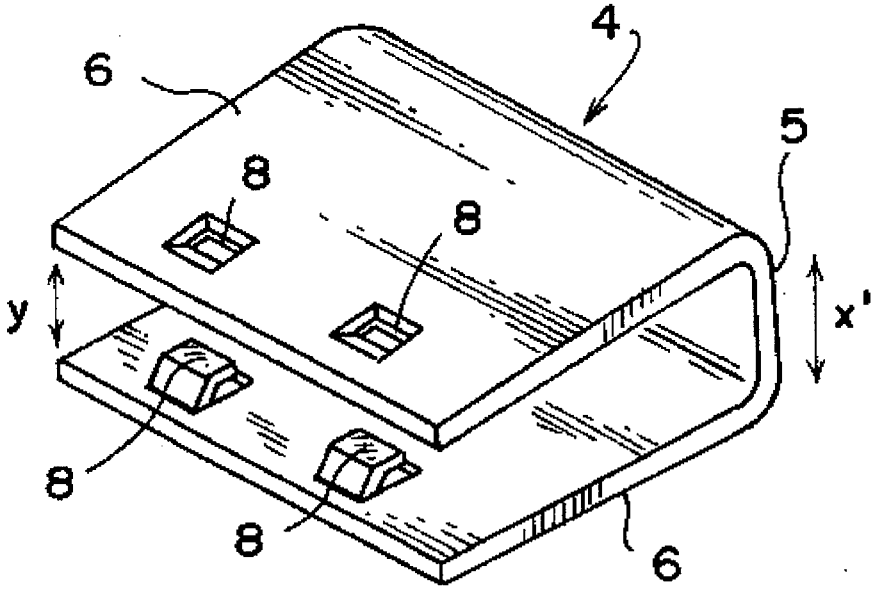

The clip body 1 includes a bending portion 2 which is bent from a center of the desired flat-plate-shaped body and has a desired width x, and upper and lower clamping pieces 3, 3 formed in a flared manner continuously from both ends of the bending portion 2. Also, in this embodiment, the top portions of the clamping pieces 3 are bent inwardly in a desired width to provide clamping portions 3*a*, whereby a space formed between the clamping portions 3*a* constitutes an inserting space z (FIG. 2(*a*)).

Therefore, in this embodiment, a width v formed between bending portions 3*b*, 3*b* that allows the clamping portions 3*a*, 3*a* to be formed is the maximum width formed between the upper and lower clamping pieces 3 of the clip body 1. In this embodiment, the clamping portions 3*a* are formed by bending the clamping piece 3. However, the top of the clamping piece 3 formed in the form of a flat-shaped plate may be made simply of the clamping portions 3*a*. In this case, the inserting space z formed by the clamping portions 3*a* is of the maximum width. Also, an width x formed by the bending portion 2 may be determined so as to properly correspond in the thickness to that of the documents to be bound into a sheaf or the like, that width being not limited. On the other hand, the pressing cover 4 has upper and lower clamping pieces continuously extending from both ends of a bending portion 5 which is bent from the center of a desired flat-plate-shaped body so as to provide a desired width x', and an inserting width y is formed between the clamping pieces 6, 6 so as to be narrower than a bending width x (FIG. 2(*b*)). Also, the inserting width y is narrower than the width x' of the bending portion 5 of the pressing cover 4. This embodiment simply shows one example, and the inserting width y may be made narrower than at least the maximum width v of the clip body 1. For example, the inserting width y may be made wider than the width formed by the inserting space z.

Respective width required above-mentioned are represented by the following expression.

(inserting width y<bending portion width x<inserting space z<width v)

However, the above expression is only one example, and at least it may satisfy the relationship of inserting width y<width v, and the relationship of inserting width y<inserting space z, or the like is not limited.

Then, a width between the upper and lower clamping pieces 6, 6 of the pressing cover 4 is expanded so that the top portions of the upper and lower clamping pieces 6, 6 are engaged with the upper and lower parts of the bending portion 2 of the clip body 1 in such a manner that the latter are inserted into the former, and the top portions of the upper and lower clamping pieces 6, 6 of the cover 4 are set to be integral with the clip body 1 so as to slide back and forth on the upper and lower clamping pieces 3, 3 of the clip body 1 in a direction of the top portions 3*a*, 3*a*. Also, when the pushing operation of the pressing cover 4 has been completed, both the clamping portions 3*a*, 3*a* which constitute the top portions of the upper and lower clamping pieces 3, 3 of the clip body 1 approach each other in the pressed state. Needless to say, both the clamping portions 3*a*, 3*a* may be brought in contact with each other.

Further, as shown in the figures, guide grooves 7 are defined on the upper faces of the upper and lower clamping pieces 3 of the clip body 1, and also inwardly curved guide pieces 8, 8 which coincide with the guide grooves 7, 7 are provided on the Lops of the upper and lower clamping pieces 6, 6 of the pressing cover 4, whereby the guide pieces 8, 8 of the pressing cover 4 are inserted into the guide grooves 7, 7 of the clip body 1 so as to be in slide contact with the grooves 7, 7 and so as not to come out from the grooves 7. As a result, the inwardly curved guide pieces 8, 8 are brought into slide contact with the guide grooves 7, 7 in such a manner that the pressing cover 4 is slidably set on the clip body 1 (refer to FIG. 1).

in this embodiment, because the guide pieces 8, 8 of the pressing cover 4 are inserted into the guide grooves 7, 7 of the clip body 1 so as to be in slide contact with the grooves 7, 7 and so as not to come out from the grooves 7, 7 and the inserting width y formed between the upper and lower clamping pieces 6, 6 of the pressing cover 4 is narrower than the width x of the bending portion x of the clip body 1, there is no fear that the clip body 1 and the pressing cover 4 are unexpectedly separated from each other.

Furthermore, as shown in another embodiment shown in FIG. 4 to 7, instead of the above guide pieces 8, one or a plurality of dimples (projections in a desired shape) may be formed on the inner faces of the tops of the upper and lower clamping pieces 6, 6 of the pressing cover 4. In this embodiment, the groove is not limited by or to a non-penetrating hole, but also means a penetrating hole as is shown in the figures.

An example of using the clip will now be described.

First, because the upper and lower clamping pieces 3, 3 are formed to expand from the bending portion 2 in a flared manner, the documents B can be smoothly inserted into the interior of the clip from the inserting space z which is formed between the top clamping portions 3*a* of the upper and lower pieces 3 (refer to FIGS. 1(*a*) and 1(*b*)).

Figure 3:
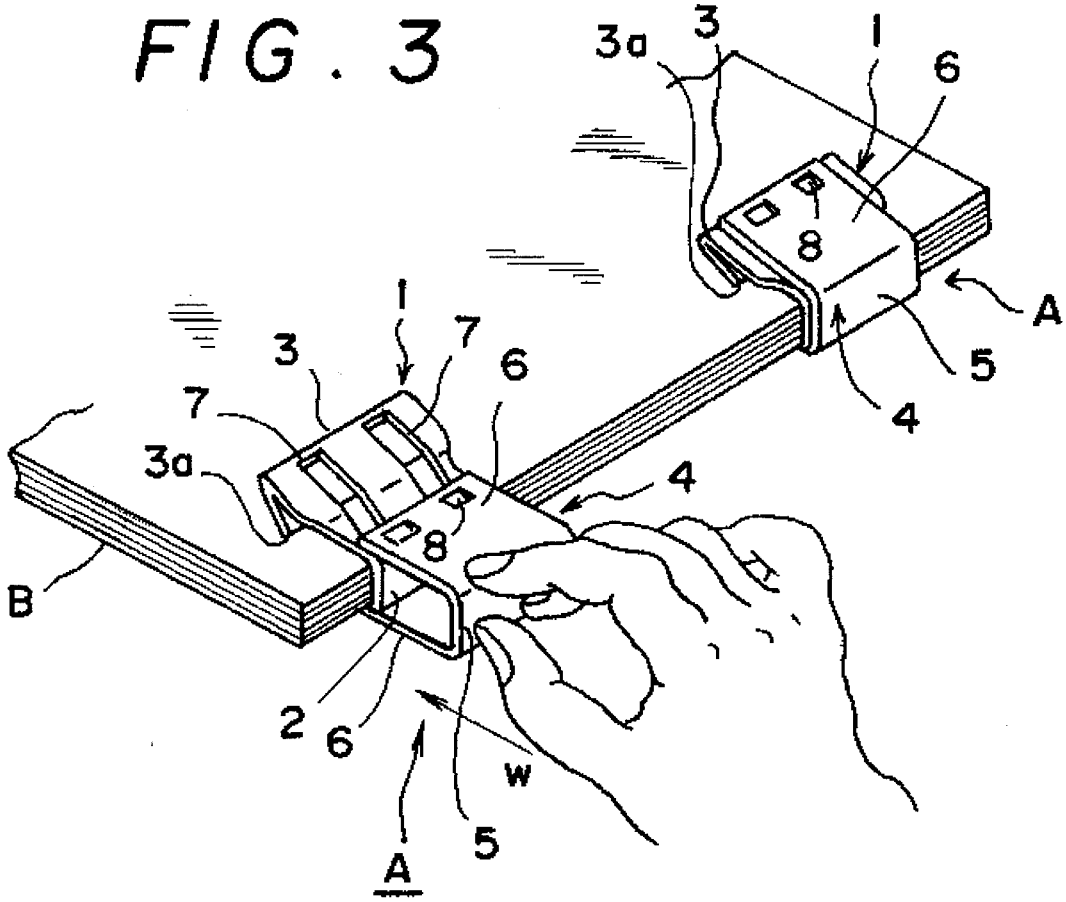
FIG. 3 is a perspective view showing a state of using the clip in according to the present invention.
Figure 4:
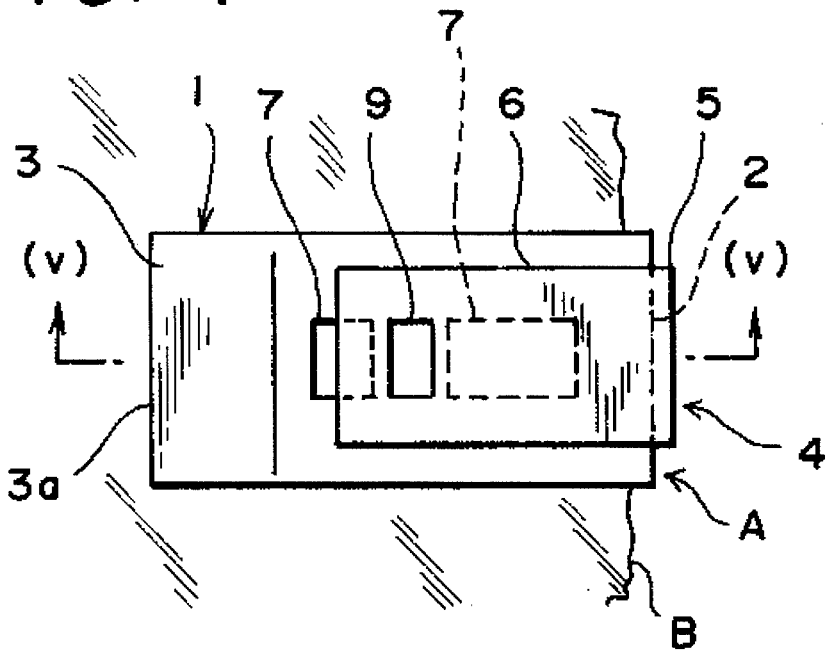
FIG. 4 is a plan view showing a clip in accordance with another embodiment of the present invention.
Figure 5:
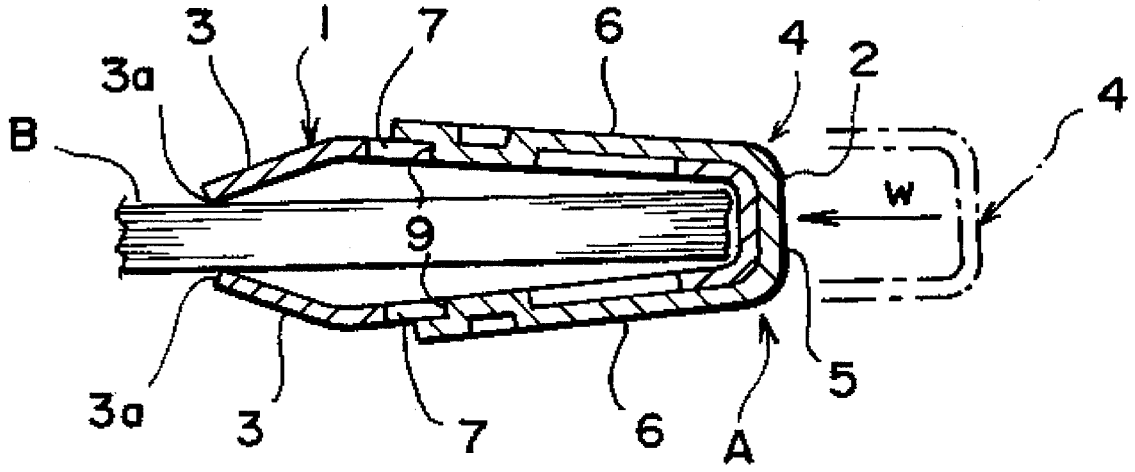
FIG. 5 is a sectional view of the clip taken along the line V—V of FIG. 4.
Figure 6:
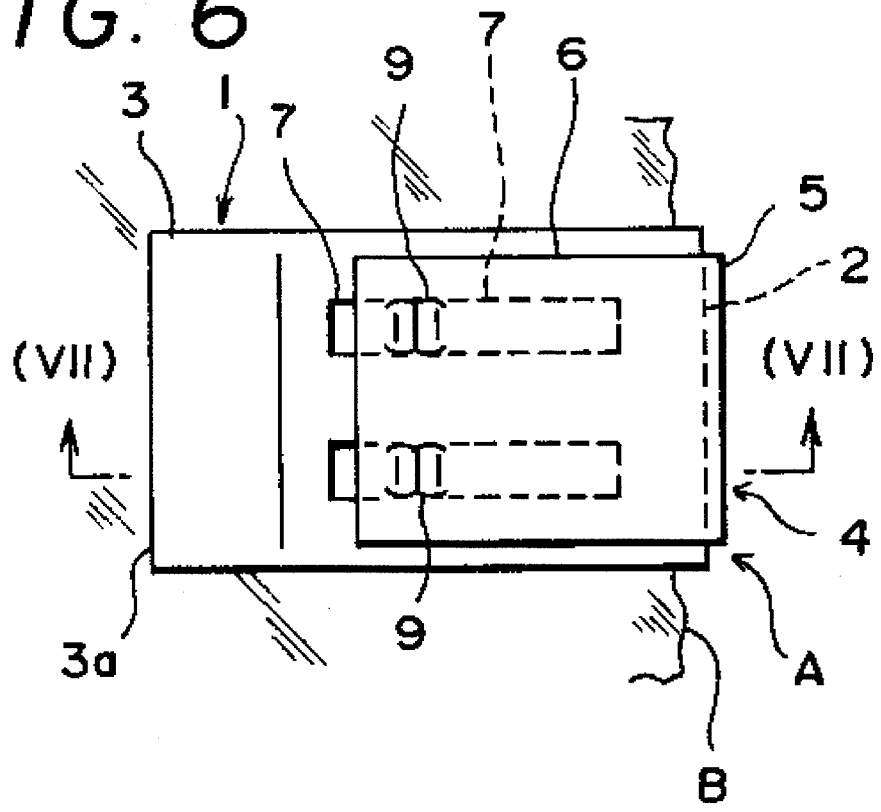
FIG. 6 is a plan view showing a clip in accordance with still another invention.
Figure 7:
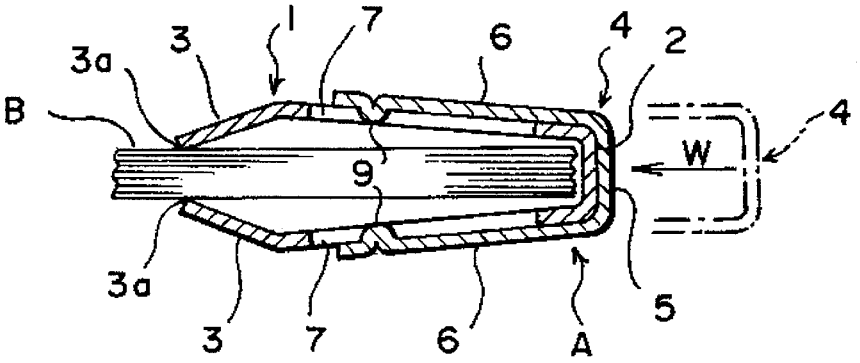
FIG. 7 is a sectional view showing the clip taken along the line VIII—VIII of FIG. 6.

Thereafter, when the pressing cover 4 is slid and pressed on the upper and lower clamping pieces 3, 3 of the clip body 1 in which the document B is set forwardly (in a direction indicated by an arrow w in the respective figures), then the upper and lower clamping pieces 6, 6 of the cover 4 press the upper and lower clamping pieces 3, 3 of the clip body 1 from the exterior inwardly so as to slide in such a manner that both the upper and lower clamping pieces 3, 3 of the clip body 1 approach each other (the inserting space z is reduced). For that reason, the documents B can be rigidly clamped by pressing the documents B from the upper and lower sides (refer to FIG. 1(*c*) and FIG. 3).

Also, because the figures show that the upper and lower pieces 3, 3 are made of an elastic material, the upper and lower clamping pieces 3, 3 are elastically deformed by pressing force of the upper and lower clamping pieces 6, 6 of the pressing cover 4, to thereby rigidly clamp the document B. In the case where the clip A of the present invention is detached, the pressing cover 4 is shifted backwardly in a reverse way so that a state where pressure is exerted on the upper and lower clamping pieces 3, 3 of the clip body 1 is released.

Figure 8:
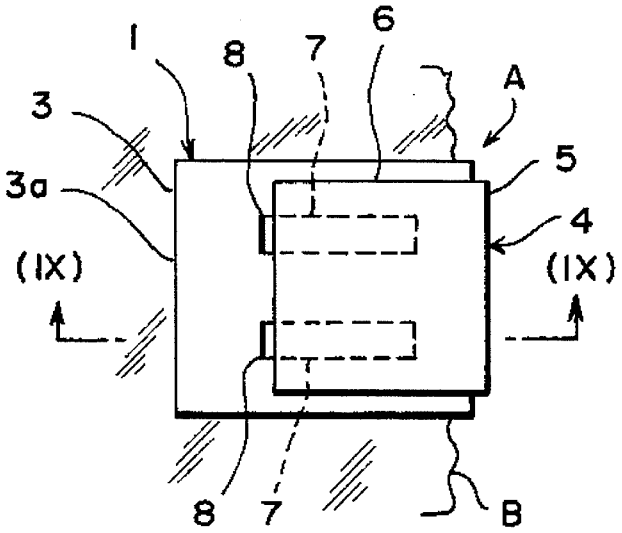
FIG. 8 is a plan view showing a clip in accordance with still another embodiment of the present invention.
Figure 9:
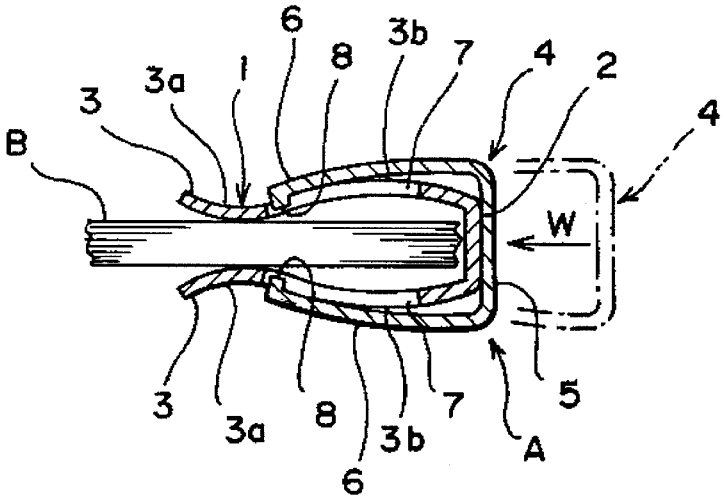
FIG. 9 is a sectional view of the clip taken along the line IX—IX of FIG. 8.

Further, FIGS. 8 and 9 show still another embodiment, which provides the pressing cover 4 having the clamping pieces 6, 6 that are formed to have such a length that the top guide pieces 8, 8 exceed the positions of the bending portions 3*b* of the clip body 1. When the top guide pieces 8 exceed the bending portion 3*b* in the operation for pushing the pressing cover 4, that is, the top guide pieces 8 exceed the bending portions 3*b* which are of dead points, because the upper and lower clamping pieces 3 of the clip body 1 are pressed, the clamping force is improved and the pressing cover excels in the prevention of coming off.

The above-described respective embodiments only show some of the examples, and the present invention is not limited by or to those embodiments. For example, the enlargement angle of the clip body 1, the respective lengths, lateral widths, and bending portion widths x, x' of the clip body 1 and the pressing cover 4 or the like can be properly and freely changed within a range of the present invention.

Also, the clip body 1 and the pressing cover 4 may be arbitrarily made of the same material or different materials.

Because the present invention has the above construction, it is a novel clip which obtains the clamping force by gradually blockading the upper and lower abutting faces of the clip body which are initially enlarged, and in comparison with the zem clip, the conventional clip in which a distance between the upper and lower abutting faces which are in a blockade state are enlarged by some external force once, and then documents or the like are clamped by its return force from the upper and lower sides, "and", the like, the present invention provides a novel and useful clip which requires no clip mounting unit and which is simple in operation and excellent in the clamping force.

That is, because the clip body 1 is in such a top-enlarged shape that the distance between the upper and lower clamping pieces are expanded from the bending portion, bound material such as the documents can be smoothly inserted into the interior of the clip, and thereafter when the pressing cover is slidably pressed on the outer portions of the clip body in which the document B is set, then the tipper and lower clamping pieces of the cover press the upper and lower clamping pieces 3 of the clip body from the exterior inwardly so as to slide in such a manner that both the tipper and lower clamping pieces of the clip body approach each other (the inserting space z is reduced) because the inserting width formed between the upper and lower clamping pieces of the cover is narrower than at least the maximum width between the upper and lower pieces of the clip body. For that reason, the bound material such as the documents can be rigidly clamped by pressing the material from the upper and lower sides.

What is claimed is:

1. A clip comprising:

a clip body having a first pair of upper and lower clamping pieces which flare continuously, wherein a bending portion extends from an end of each of the upper and lower clamping pieces of the first pair to define an opening having a first desired width; and a pressing cover having a second pair of upper and lower clamping pieces continuously extending from both ends of a base portion which is formed so as to define a second desired width, wherein said second pair of upper and lower clamping pieces is to be engaged with said first pair of upper and lower clamping pieces close to the bending portion of said clip body, and wherein a clamping width formed between ends of said second pair of clamping pieces is narrower than the first desired width formed between said first pair of upper and lower clamping portions of the clip body;

wherein the other end of said first pair of upper and lower clamping pieces of said clip body are bent inwardly and toward said bending portion;

wherein guide grooves are defined in each of said first pair of upper and lower clamping pieces of said clip body, wherein said guide grooves on each of said first pair of clamping pieces are spaced in two rows, and guide pieces are provided on each of said second pair of upper and lower clamping pieces of said pressing cover to engage with said guide grooves;

wherein said pressing cover is slidably provided on outer portions of the clip body so that said first pair of upper and lower clamping pieces of said clip body approach each other in a pressing state.

2. A clip as claimed in claim 1, wherein said clip body and said pressing cover are made of an elastic material.

3. A clip as claimed in claim 1, wherein said clip body and said pressing cover are made of an elastic material.

* * * * *